United States Patent [19]

Marcade

[11] Patent Number: 4,739,233

[45] Date of Patent: Apr. 19, 1988

[54] MOTOR CONTROL FOR AN ICE DISPENSING APPARATUS

[75] Inventor: Roque D. Marcade, Lincoln Township, Berrien County, Mich.

[73] Assignee: Whirlpool Corporation, Benton Harbor, Mich.

[21] Appl. No.: 80,644

[22] Filed: Jul. 31, 1987

[51] Int. Cl.[4] ..... H02P 1/00; F25C 5/16

[52] U.S. Cl. ..... 318/474; 318/3; 318/558; 62/344; 221/75

[58] Field of Search ..... 318/474, 3, 519, 558; 62/344; 221/75; 241/63, 64, 82.1, 82.2, 222; 364/478, 479

[56] References Cited

U.S. PATENT DOCUMENTS

| | | | |
|---|---|---|---|
| 3,299,656 | 1/1967 | Linstromberg et al. | 62/233 |
| 4,104,889 | 8/1978 | Hoenisch | 62/344 X |
| 4,417,671 | 11/1983 | Kawasaki et al. | 62/137 X |
| 4,424,683 | 1/1984 | Manson | 62/233 X |
| 4,628,699 | 12/1986 | Mawby et al. | 62/344 X |

*Primary Examiner*—Bentsu Ro

*Attorney, Agent, or Firm*—Wood, Dalton, Phillips, Mason & Rowe

[57] ABSTRACT

A motor control for a refrigeration apparatus having a cabinet, a door to the cabinet, a source of ice pieces located in the cabinet, means located in the door for dispensing the ice pieces, a power source having a supply terminal and a ground, a motor and means responsive to operation of the motor for delivering the ice pieces from the source of the ice pieces to the dispensing means, the motor control comprising means for energizing the motor, an actuable ice command switch generating an ice command signal for requesting delivery of the ice pieces from the source to the dispensing means, a processor having an input terminal coupled to the ice command switch and an output terminal, the processor generating a transistor command signal in response to the ice command signal, and a transistor having a control electrode coupled to the output terminal and first and second main current electrodes, wherein the processor output terminal is coupled to the transistor control electrode, and the motor energizing means, the ice command switch and the transistor first and second main current electrodes are coupled in series between the supply terminal and ground such that the transistor is actuated in response to the transistor command signal and current flows through the motor energizing means to energize the motor only upon actuation of both the ice command switch and the transistor.

19 Claims, 3 Drawing Sheets

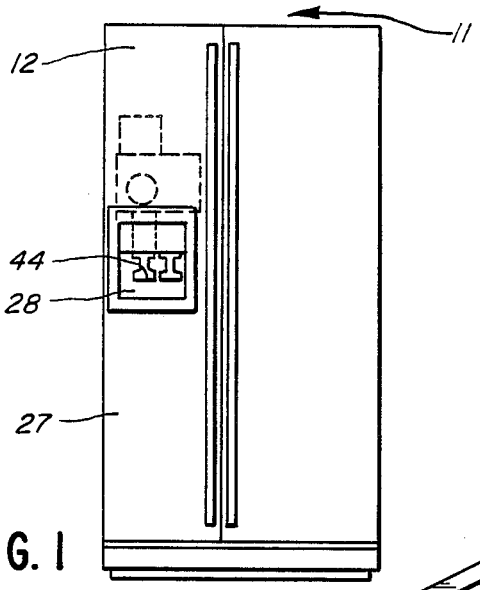
FIG. 1
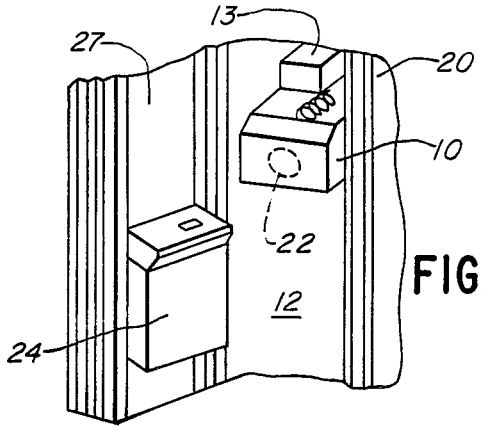
FIG. 2
FIG. 3
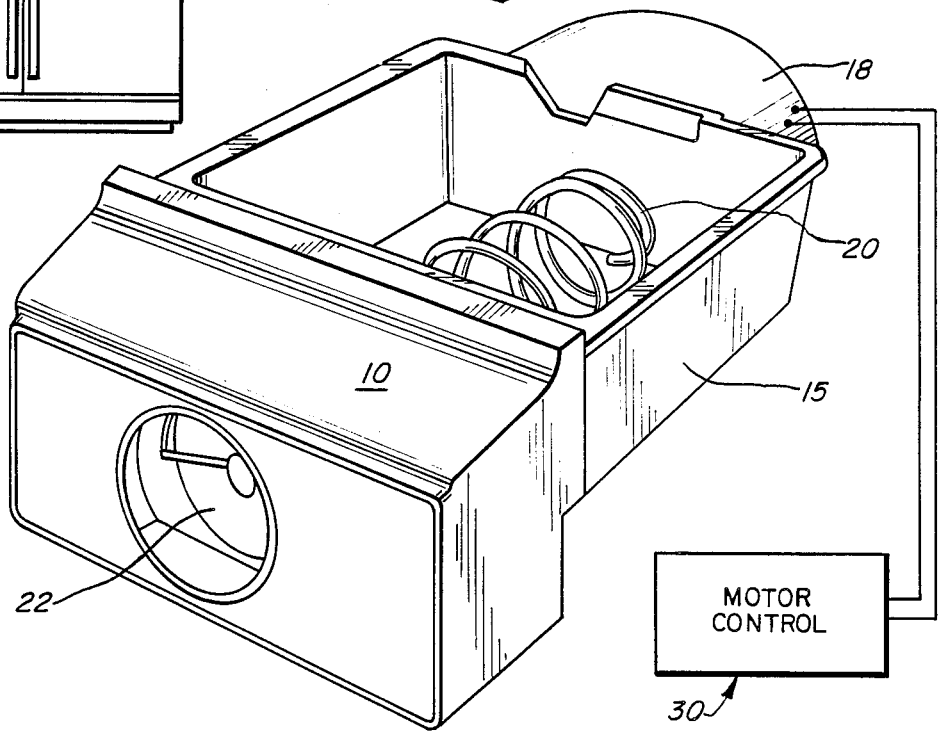
FIG. 4
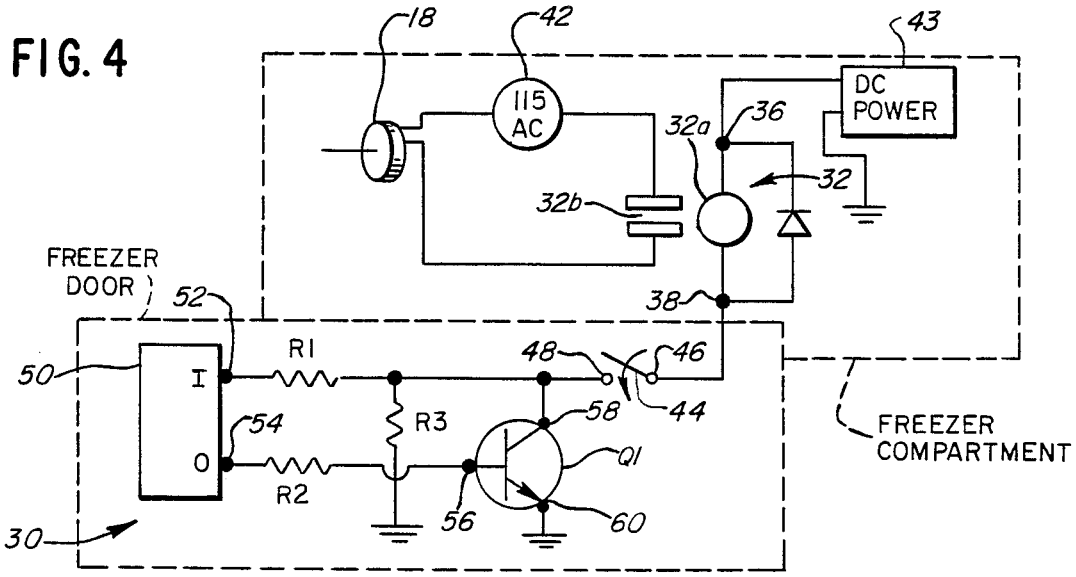

MOTOR CONTROL FOR AN ICE DISPENSING APPARATUS

FIELD OF THE INVENTION

The present invention relates to an ice dispensing apparatus for dispensing ice pieces through a door of a refrigerator/freezer and more particularly to a processor based circuit for controlling rotation of a motor to dispense the ice pieces.

BACKGROUND OF THE ART

Modern refrigerator/freezers often include an ice dispenser for dispensing ice pieces formed in the freezer compartments into a discharge station on the exterior of the freezer door.

Typically the ice dispenser includes a motor and a motor control circuit. The motor control circuit is actuated by an ice command switch located at the discharge station. The ice command switch is actuated by a glass or other container placed against the switch, causing the motor to rotate and deliver a desired quantity of the ice pieces into the glass.

One such ice dispensing apparatus is disclosed in pending Linstromberg et al, U.S. patent application Ser. No. 747,890, filed June 24, 1985, entitled "Ice Dispensing Apparatus", and assigned to Whirlpool Corporation, assignee of the instant application.

According to Linstromberg et al, actuation of a switch energizes an analog timing circuit coupled to a triac. Upon actuation of the switch, the timing circuit turns on the triac, allowing current to flow through a motor connected in series with the triac.

The timing circuit includes an RC network. Upon actuation of the switch, the capacitor of the RC network begins to charge. When the capacitor has charged to a predetermined level, the timing circuit turns off the triac, preventing flow of current through the motor and hence stopping it and delivery of ice pieces. The RC circuit includes a selectively variable resistor for a variable capacitor charge time, resulting in a selective motor rotation time.

However, according to Linstromberg et al, the ice start switch must operate at the same high potential as the motor. Further, a conductor handling a high voltage and high current must traverse the joint between the freezer door and the freezer compartment.

SUMMARY OF THE INVENTION

The present invention comprehends a motor control circuit for dispensing ice pieces from a refrigeration apparatus having a freezer cabinet, a door to the freezer cabinet, a source of ice pieces located in the freezer cabinet, means located in the door for dispensing the ice pieces into a container, a power source having a supply terminal and a ground, a motor, and means responsive to rotation of the motor for delivering the ice pieces from the source of the ice pieces to the dispensing means.

The motor control circuit comprises means for energizing the motor, a manually actuated ice command switch generating an ice command signal for requesting delivery of the ice pieces from the source to the dispensing means, a processor having an input terminal and an output terminal, the processor generating a switch or transistor command signal at the processor output terminal in response to the ice command signal and a controllable switch such as a transistor having a control electrode and first and second main current electrodes. The transistor control electrode is coupled to the processor output terminal. The motor energizing means, the ice command switch and the first and second main current electrodes are coupled in series between the power terminal and ground. The transistor is actuated in response to the transistor command signal such that current flows through the motor energizing means to energize the motor only upon actuation of both the ice command switch and the transistor.

In a first embodiment of the instant circuit, the motor energizing means has a first terminal coupled to the power terminal and a second terminal. The ice command switch has a switch first terminal coupled to the motor energizing means second terminal and a switch second terminal coupled to the processor input terminal. The transistor first main current electrode is coupled between the switch second terminal and the processor input terminal and the transistor second main current electrode is coupled to ground.

More specifically, the motor energizing means is located in the freezer cabinet and the ice command switch, the processor and the transistor are associated with the door.

According to the first embodiment, often the transistor is turned on in response to generation of the transistor command signal, the voltage at the input terminal remains low regardless of the state of the switch. Therefore, the processor periodically confirms continued actuation of the ice command switch by momentarily stopping generation of the transistor command signal to momentarily shut off the transistor. With the transistor momentarily shut off, the voltage at the input terminal of the processor will go high if the switch is closed, but will remain low if the switch is open. Thus, the processor can determine the state of the switch.

According to a second embodiment, the motor energizing means has a first terminal coupled to the power terminal and a second terminal. The ice command switch has a first terminal coupled to the processor input terminal and a second terminal coupled to ground. The transistor first main current electrode is coupled to the motor energizing means second terminal. The processor input terminal is coupled to the switch first terminal and the transistor second main current electrode is coupled between the processor input terminal and the switch first terminal.

More specifically, the ice command switch is located on the door and the motor energization means, the processor and the first transistor are located within the freezer cabinet.

The motor energizing means comprises a relay including a winding and a normally open contactor wherein the contactor is in series with both a power supply and the motor, such that current flow through the winding causes the normally open contactor to close, energizing the motor.

BRIEF DESCRIPTION OF THE DRAWINGS

Other features and advantages of the invention will be apparent from the following description taken in connection with the accompanying drawings wherein:

FIG. 1 is a front elevational view of a refrigeration apparatus having an ice dispensing apparatus;

FIG. 2 is a fragmentary perspective view illustrating the location of the ice dispensing apparatus within the refrigeration apparatus;

FIG. 3 is a perspective view illustrating the ice dispensing apparatus;

FIG. 4 is a schematic diagram illustrating a first embodiment of the instant invention;

BEST MODE FOR CARRYING OUT THE INVENTION

Figure 5:
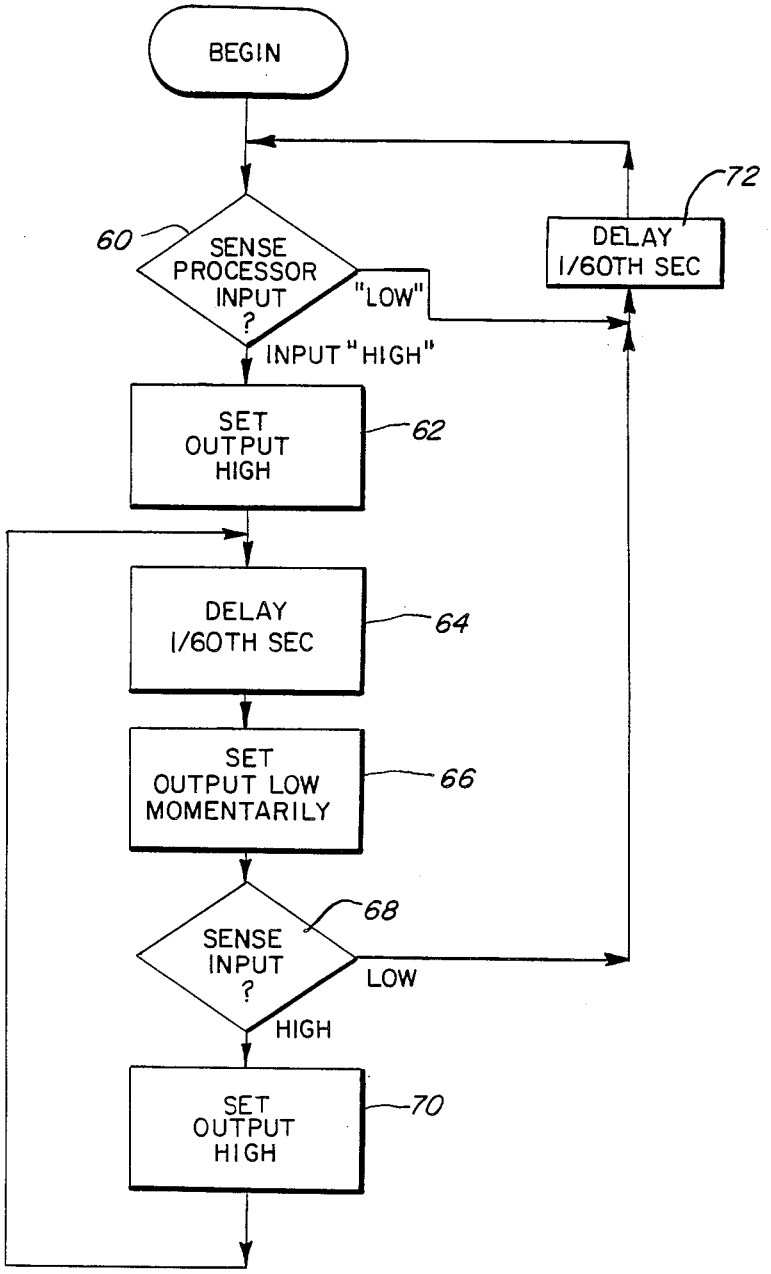
FIG. 5 is a flow chart illustrating a processor routine utilized in the first embodiment to confirm continued actuation of the ice command switch.

An ice dispensing apparatus 10 mounted in a refrigeration apparatus 11 is illustrated in FIGS. 1–3. The ice dispensing apparatus 10 comprises, for example, a side-by-side refrigerator/freezer. As illustrated in FIG. 2, the ice dispensing apparatus 10 is disposed within a freezer compartment 12 below a conventional ice maker 13, illustratively of the type shown in U.S. Pat. No. 3,299,656.

Ice pieces are formed by the ice maker 13 and delivered downwardly therefrom into a rear portion of an upwardly opening storage receptacle 15. A motor 18 rotates a helical rod 20 comprising an auger type conveyer, causing ice pieces within the storage receptacle 15 to move forwardly, exiting the storage receptacle 15 through a baffle 22 into a discharge chute 24. The discharge chute 24 extends through a freezer compartment door 27 to a discharge station 28.

A more detailed description of an ice dispenser is disclosed in the Linstromberg et al application, referred to above.

The motor 18 is coupled to a motor control circuit 30, discussed in greater detail below.

A first embodiment of the present circuit is illustrated in FIG. 4. The motor control circuit 30 comprises a relay 32 including a winding **32*a* having winding first and second ends 36, 38 and a normally open contactor 32*b*. The normally open contactor 32*b* is coupled in series with a 115 volt AC power supply 42 and the motor 18. Current flow through the winding 32*a* causes the normally open contactor 32*b* to close, energizing the motor 18**.

A DC power supply 43 having a DC power terminal and ground provides low voltage DC power controlled by circuit 30.

The circuit further includes a manually-actuated ice command switch 44 having first and second terminals 46, 48. The switch 44 is located at the ice dispenser station 28 (FIG. 1) and is typically actuated by a glass or other dispenser.

The control further includes a processor 50, for example, an NEC 7538 or a Motorola 6805 microprocessor. The processor 50 has an input terminal 52 and an output terminal 54. Also included is a controllable switch in the form of a driver transistor Q1 having a control electrode 56 and first and second main current electrodes 58, 60. The processor input terminal 52 is coupled to the switch second terminal 48. The switch second terminal 48 is also coupled to ground by a resistor R3. The processor output terminal 54 is coupled to the transistor driver control electrode 56. The winding **32*a*, the switch 44 and the first and second main current electrodes 58, 60** are coupled in series between the DC power terminal and ground.

When the ice command switch 44 is open, the voltage at the processor input terminal 52 is low. Upon actuation or closure of the switch 44, the voltage at the processor input terminal 52 assumes a high state. The voltage applied to the processor input terminal 52 upon actuation of the switch 44 is herein referred to as an ice command signal. In response to the ice command signal, the processor output terminal 54 assumes a high state, generating what is herein referred to as a transistor command signal. The transistor command signal turns on the driver transistor Q1. When the driver transistor Q1 is on, current flows from the DC power terminal through the winding **32*a*, the ice command switch 44 and the main current electrodes 58, 60 of the transistor Q1 to ground. As discussed above, current flow through the winding 32*a* closes the normally open contactor 32*b*, energizing the motor 18**.

When the driver transistor Q1 is on, the voltage at the processor input terminal 52 returns to a low state because the driver transistor shorts the processor input 52 to ground. Thus, although a subsequent opening of the switch 44 will terminate energization of the motor 18, the processor 50 will not know that the switch 44 has been opened. In order to overcome this, the processor 50 periodically performs a routine to momentarily terminates the transistor control signal to momentarily shut off the driver transistor Q1 and permit sensing of the state of the switch 44.

FIG. 5 illustrates the routine performed by the processor 50 to determine the state of the switch 44. At a first block 60, the processor 50 determines the voltage at the processor input 52. If the voltage at the processor input terminal 52 is high, indicating actuation of the switch 44, the processor sets the voltage at the processor output terminal 54 high as illustrated at block 62. The processor 50 then pauses for 1/60 of a second, and then a block 66 momentarily stops generation of the transistor command signal.

Termination of the transistor command signal turns off the driver transistor Q1, and a block 68 again senses the voltage at the processor input terminal 52.

The processor output terminal 54 is shut off only for a time sufficient to shut off the driver transistor Q1 and sense the state of the switch 44. This is accomplished in a time period short enough that the contactor **32*b*** does not open, and hence the motor rotation is not effected by this routine.

If the block 68 senses that the voltage at the processor input terminal 52 is high, indicating that the switch 44 remains closed, the voltage at the processor output terminal 54 is set high again by a block 70, and control returns to the block 64. If the block 68 determines that the voltage at the processor input terminal 52 is low, indicating that the switch 44 is currently open, the processor then waits another 1/60 second and control passes to the block 60 which senses the state of the switch 44.

Figure 6:
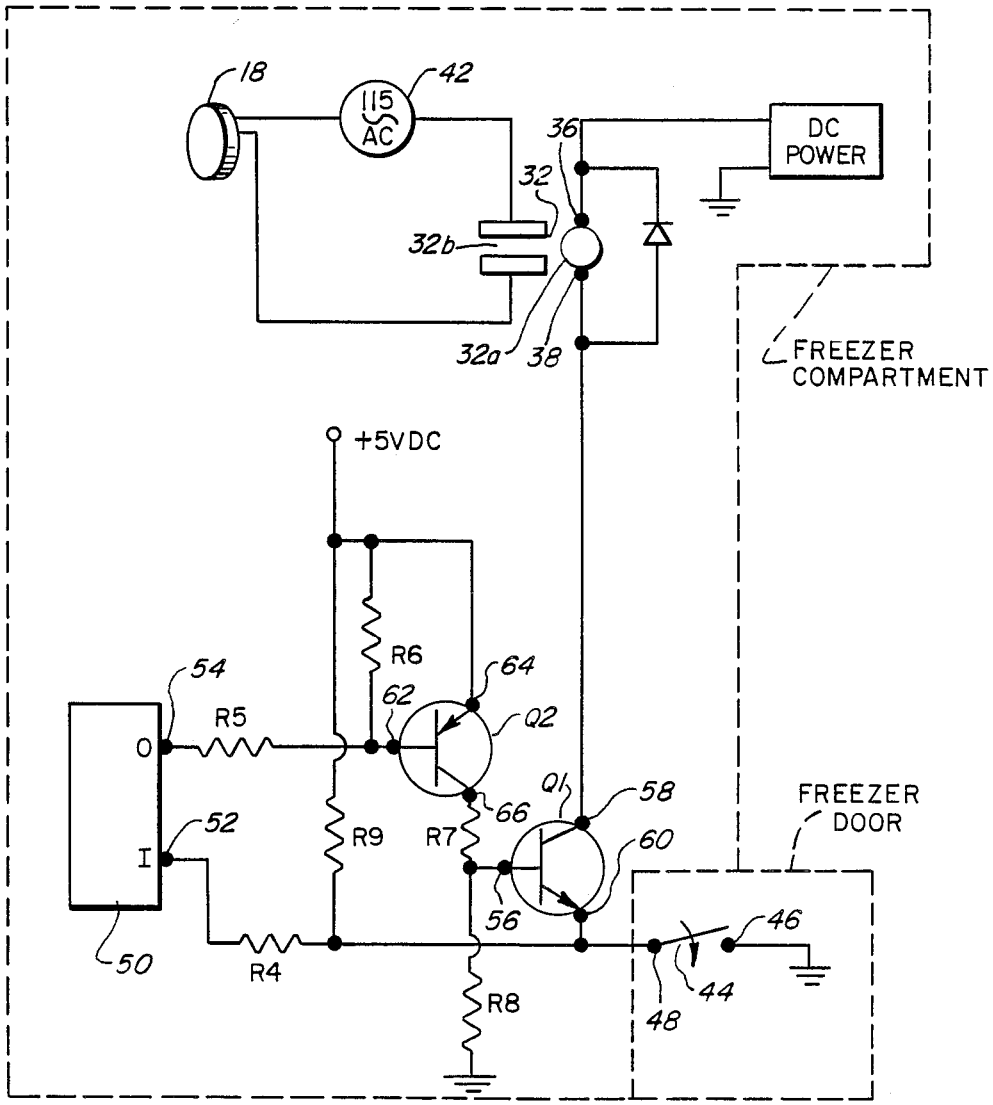
FIG. 6 is a schematic diagram illustrating a second embodiment of the instant invention.

A second embodiment of the present circuit is illustrated in FIG. 6. Elements of the second embodiment corresponding to elements of the first embodiment have been similarly numbered.

According to the second embodiment, the first end 36 of the winding **32*a* is coupled to the DC power terminal and the second end 38 of the winding 32*a* is coupled to the first main current electrode 58 of the driver transistor Q1. The switch first terminal 48 is coupled to the processor input terminal 52 and the switch second terminal 46 is coupled to ground. The driver transistor control electrode is coupled to the processor output terminal 54 via a second transistor Q2, and to ground. The driver transistor second main current electrode is coupled to the processor input terminal 52 through a resistor R4 and to the switch first terminal 48**.

The second transistor Q2 includes a control electrode 62 coupled to the processor output terminal 54 through a resistor R5, a first main current electrode 64 coupled to a 5 vDC power source and a second main current electrode 66 coupled to the drive transistor control electrode 56 through a resistor R7.

The junction of the resistor R4 and the switch first terminal 48 is also coupled to the +5 vDC voltage source through a resistor R9.

When the switch 44 is open, the voltage at the processor input terminal 52 is high, and the processor maintains the voltage at the processor output terminal 54 high. Thus, the transistors Q2 and Q1 are off to prevent energization of the motor 18. When the switch 44 is closed, however, the voltage at the processor input terminal 52 assumes a low state. The processor 50 then develops a low state signal at the processor output terminal 54. This turns on the control transistor Q2, which in turn energizes the driver transistor Q1. With the driver transistor Q1 turned on, current flows from the DC power terminal through the winding 32*a* to ground, closing the normally open contactor 32*b* and energizing the motor 18. In accordance with the second embodiment, the ice switch is located on the freezer door and the winding 32*a*, the first and second transistors Q1, Q2 and the processor 50 are each located in the freezer cabinet.

Modern refrigerator/freezers have a processor to perform a variety of other functions. According to the present invention, the processor 50 can be utilized in the instant circuit to perform such a function as timing to control the quantity of ice dispensed, but requires no other dedicated timing circuitry. Additionally, even though the processor 50 is involved, the switch 44 continues to provide a positive shut-off of the ice pieces regardless of the processor 50. Further, the instant circuit requires only a single, low voltage dedicated conductor traversing the junction of the freezer door 27 and the freezer compartment 12.

I claim:

1. In a refrigeration apparatus having a cabinet, a door to the cabinet, a source of ice pieces located in the cabinet, means located in the door for dispensing the ice pieces, a power source having a supply terminal and a ground, a motor and means responsive to operation of the motor for delivering the ice pieces from the source of the ice pieces to the dispensing means, a motor control comprising:

means for energizing the motor;

an actuable ice command switch generating an ice command signal for requesting delivery of the ice pieces from the source to the dispensing means;

a processor having an input terminal coupled to the ice command switch and an output terminal, the processor generating a transistor command signal in response to the ice command signal; and a transistor having a control electrode coupled to the output terminal and first and second main current electrodes, wherein:

the processor output terminal is coupled to the transistor control electrode, and the motor energizing means, the ice command switch and the transistor first and second main current electrodes are coupled in series between the supply terminal and ground such that the transistor is actuated in response to the transistor command signal and current flows through the motor energizing means to energize the motor only upon actuation of both the ice command switch and the transistor.

2. The refrigeration apparatus of claim 1 wherein:

the motor energizing means has a first terminal coupled to the supply terminal, and a second terminal;

the ice command switch has a switch first terminal coupled to the motor energizing means second terminal and a switch second terminal coupled to the processor input terminal;

the transistor first main current electrode is coupled between the switch second terminal and the processor input terminal; and the transistor second main current electrode is coupled to ground.

3. The refrigeration apparatus of claim 2 wherein the processor confirms continued actuation of the ice command switch.

4. The refrigeration apparatus of claim 3 wherein the processor confirms continued actuation of the ice command switch by periodically stopping generation of the transistor command signal and sensing the voltage at the processor input terminal.

5. The refrigeration apparatus of claim 2 wherein:

the motor energizing means is located within the cabinet; and the ice command switch, the processor and the transistor are located in the door.

6. The refrigeration apparatus of claim 1 wherein:

the motor energizing means has a first terminal coupled to said supply terminal, and a second terminal;

the ice command switch has a first terminal coupled to the processor input terminal and a second terminal coupled to ground;

the transistor first main current electrode is coupled to the motor energizing means second terminal; and the transistor second main current electrode is connected to the processor input terminal and the switch first terminal.

7. The refrigeration apparatus of claim 6 wherein:

the ice command switch is located in the door; and the motor energizing means, the processor and the transistor are located in the cabinet.

8. The refrigeration apparatus of claim 6 including a second transistor having a control electrode and first and second main current electrodes, wherein the processor output terminal is coupled to the second transistor control electrode, the second transistor first main current electrode is coupled to the power source supply terminal and the second transistor second main current electrode is coupled to the first-mentioned transistor control electrode.

9. In a refrigeration apparatus having a cabinet, a door to the cabinet, a source of ice pieces, means for dispensing the ice pieces, a power source having a supply terminal and a ground, a motor rotatable upon energization, means having a first and second terminal and responsive to current flow for energizing the motor, and means responsive to rotation of the motor for delivering the ice pieces from the source to the dispensing means, a motor control comprising;

an ice command switch having first and second terminals and actuable to request delivery of a quantity of ice pieces;

a first transistor having a control electrode and first and second main current electrodes, wherein the first and second main current electrodes of the first transistor, the ice command switch and the motor energizing means are coupled in series between the supply terminal and ground; and a processor having an input terminal coupled to the ice command switch first terminal and an output terminal coupled to the first transistor control electrode, wherein the processor generates a transistor command signal at the processor output terminal in response to actuation of the ice command switch, said transistor command signal turning on the first transistor, allowing current to flow from the power supply through the motor energizing means to ground and energizing the motor.

10. The refrigeration apparatus of claim 9 wherein the motor energizing means first terminal is coupled to the supply terminal, the motor energizing means second terminal is coupled to the switch first terminal, the switch second terminal is coupled to the processor input terminal, the processor output terminal is coupled to the first transistor control electrode, the first transistor first main current electrode is connected to the ice command switch second terminal and the processor input terminal, and the first transistor second main current electrode is coupled to said power source ground, such that actuation of the ice command switch generates a logical high signal at the processor input terminal, resulting in the generation of the transistor command signal.

11. The refrigeration apparatus of claim 10 wherein the processor periodically confirms continued actuation of the ice command switch.

12. The refrigeration apparatus of claim 11 wherein the processor confirms the continued actuation of the ice command switch by momentarily stopping generation of the transistor command signal and sensing the voltage at the processor input terminal.

13. The refrigeration apparatus of claim 10 wherein:

the motor energizing means is located in the cabinet; and the ice command switch, the processor and the first transistor are located in the door.

14. The refrigeration apparatus of claim 9 wherein the motor energizing means first terminal is coupled to the power source supply terminal, the motor energizing means second terminal is coupled to the first transistor first main current electrode, the processor input terminal is coupled to the switch first terminal, the first transistor second main current electrode is connected to the processor input terminal and the switch first terminal, the processor output terminal is coupled to the first transistor control electrode, and the switch second terminal is coupled to ground, such that actuation of the ice command switch generates a logical low signal at the input terminal and the processor generates the transistor command signal in response to the logical low signal.

15. The refrigeration apparatus of claim 14 wherein the switch is located in the door and the motor energizing means, the processor and the first transistor are located in the cabinet.

16. The refrigeration apparatus of claim 14 including a second transistor having a control electrode coupled to the processor output terminal, a second transistor first main current electrode coupled to the supply terminal and a second transistor second main current electrode coupled to the first transistor control electrode, wherein the transistor command signal turns on the second transistor which resultingly turns on the first transistor.

17. In a refrigeration apparatus having a cabinet, a door joined to the cabinet, a source of ice pieces located in the cabinet, means associated with the door for dispensing the ice pieces into a container, a power source having a supply terminal and a ground, a motor and means associated with the cabinet and responsive to rotation of the motor for delivering the ice pieces from the source to the dispensing means, a motor control circuit requiring a single dedicated wire traversing the joint between the cabinet and the door comprising;

an ice command switch located in the door for requesting delivery of a quantity of the ice pieces and having first and second terminals;

a motor control relay located in the cabinet and comprising a winding and a contactor for energizing the motor in response to current flow through the winding, wherein the winding has a first terminal coupled to the power source supply terminal and a second terminal coupled to the switch first terminal;

a processor located in the cabinet and having an input terminal coupled to the switch second terminal, and an output terminal;

a first transistor located in the cabinet and having a control electrode coupled to the processor output terminal, a first main current electrode coupled between the switch second terminal and the processor input terminal and a second main current electrode coupled to ground, wherein the processor generates a transistor command signal at the processor output terminal in response to actuation of the ice command switch, the transistor command signal turning on the first transistor, allowing current to flow from the supply terminal through the winding to ground, energizing the winding, causing the motor contactor to close and energizing the motor.

18. The refrigeration apparatus of claim 17 wherein the processor periodically confirms continued actuation of the ice command switch.

19. In a refrigeration apparatus having a cabinet, a door to the cabinet, a source of ice pieces located in the cabinet, means located in the door for dispensing the ice pieces into a container, a power source having a supply terminal and a ground, a motor, and means responsive to rotation of the motor for delivering the ice pieces from the source of the ice pieces to the dispensing means, a motor control comprising;

a motor control relay located in the cabinet and comprising a winding and a contactor for energizing the motor in response to current flow through the winding, the winding having a first terminal coupled to the power source supply terminal and a second terminal;

a processor located in the cabinet and having an input terminal and an output terminal;

an ice command switch located in the door for requesting delivery of a quantity of the ice pieces and having a first terminal coupled to the processor input terminal and a second terminal coupled to ground;

a first transistor located in the cabinet and having a control electrode coupled to the output terminal of the processor, a first main current electrode coupled to the relay winding second terminal and a second main current electrode coupled between the processor input terminal and the ice command switch first terminal, wherein the processor generates an output signal at the processor output terminal in response to actuation of the ice command switch, the output signal turning on the first transistor, allowing current to flow from the power supply through the winding to ground, closing the motor contactor to energize and rotate the motor.

* * * * *